US005327594A

United States Patent [19]

Sun

[11] Patent Number: 5,327,594

[45] Date of Patent: Jul. 12, 1994

[54] SLIDING RAILS FOR CRIB RAIL

[76] Inventor: Chin-Yau Sun, 352, Sec. 1, Sha-Tyan Rd., Da-Duu Country, Taichung Country, Taiwan

[21] Appl. No.: 51,672

[22] Filed: Apr. 23, 1993

[51] Int. Cl.[5] ..... A47D 7/02

[52] U.S. Cl. ..... 5/100

[58] Field of Search ..... 5/100, 93.1, 428

[56] References Cited

U.S. PATENT DOCUMENTS 2,804,631 9/1957 Levin ..... 5/100

3,896,514 7/1975 Feldstein ..... 5/100

*Primary Examiner*—Alexander Grosz

*Attorney, Agent, or Firm*—Larson and Taylor

[57] ABSTRACT

A device for positioning a slidable crib rail including a sliding rail having an upper and a lower locating hole, and an upper and a lower arresting block located closer to an end of the sliding rail than the upper and the lower locating hole respectively. The device also includes a moving member for positioning the crib rail along the sliding rail. This moving member includes a control member having a retaining device retaining the moving member in the locating holes of the sliding rail, and a movable plate having a first position for biasing the retaining means in a position in which the retaining means cannot retain the moving member in the locating holes and a second position which does not influence the retaining means. The upper arresting block of the sliding rail is situated to move the movable plate from its second position to its first position, and the lower arresting block of the sliding rail is situated for moving the movable member from its first position to its second position. Thus, the slidable crib rail can be positioned downwards with upward movement from an adult using only one hand, but not with downward pressure exerted by an infant.

14 Claims, 4 Drawing Sheets

SLIDING RAILS FOR CRIB RAIL

BACKGROUND OF THE INVENTION

The present invention relates generally to a crib, and more particularly to a slidable crib rail.

In general, a conventional crib has a crib frame which comprises four high sides and a bottom board. In order to safeguard the baby in the crib, while allowing easy removal of the baby, one of the four high sides of the crib can slide upwards or downwards. Typically, the slidable side of the crib is provided respectively at both ends thereof with a snap-type retaining block having a slanted surface capable of being retained by the notches of two guide rods located at both ends of the slidable side of the crib. The retaining block can be pressed in order to disengage the slanted surface thereof from the notches of the guide rod, thereby enabling the slidable side of the crib to be moved upwards or downwards. The process of sliding the slidable side of the conventional crib into position as described above must be carried out with both hands, which can result in injuries and is inconvenient.

SUMMARY OF THE INVENTION

It is therefore the primary objective of the present invention to provide a slidable crib rail which can be positioned easily and safely with one hand and which can be made at a low cost.

The foregoing objective of the present invention is attained by a device for positioning slidable crib rail comprising a sliding rail including an upper and a lower locating hole, and an upper and a lower arresting block located closer to an end of the sliding rail than the upper and the lower locating hole, respectively. The device also includes a moving member for positioning the crib rail along the sliding rail. This moving member includes a control member having a retaining device which retains the moving member in the locating holes. The moving member further includes a movable plate having a first position for biasing the retaining device in a position in which the retaining device cannot retain the moving member in the locating holes and a second position which does not influence the retaining means. The upper arresting block of the sliding rail is situated to move the movable plate from its second position to its first position, and the lower arresting block is situated to move the movable plate from its first position to its second position.

The slidable crib rail can be positioned downwards with upward movement from an adult, but not with downward pressure exerted by an infant.

DETAILED DESCRIPTION OF THE INVENTION

Figures 1A, 1B:
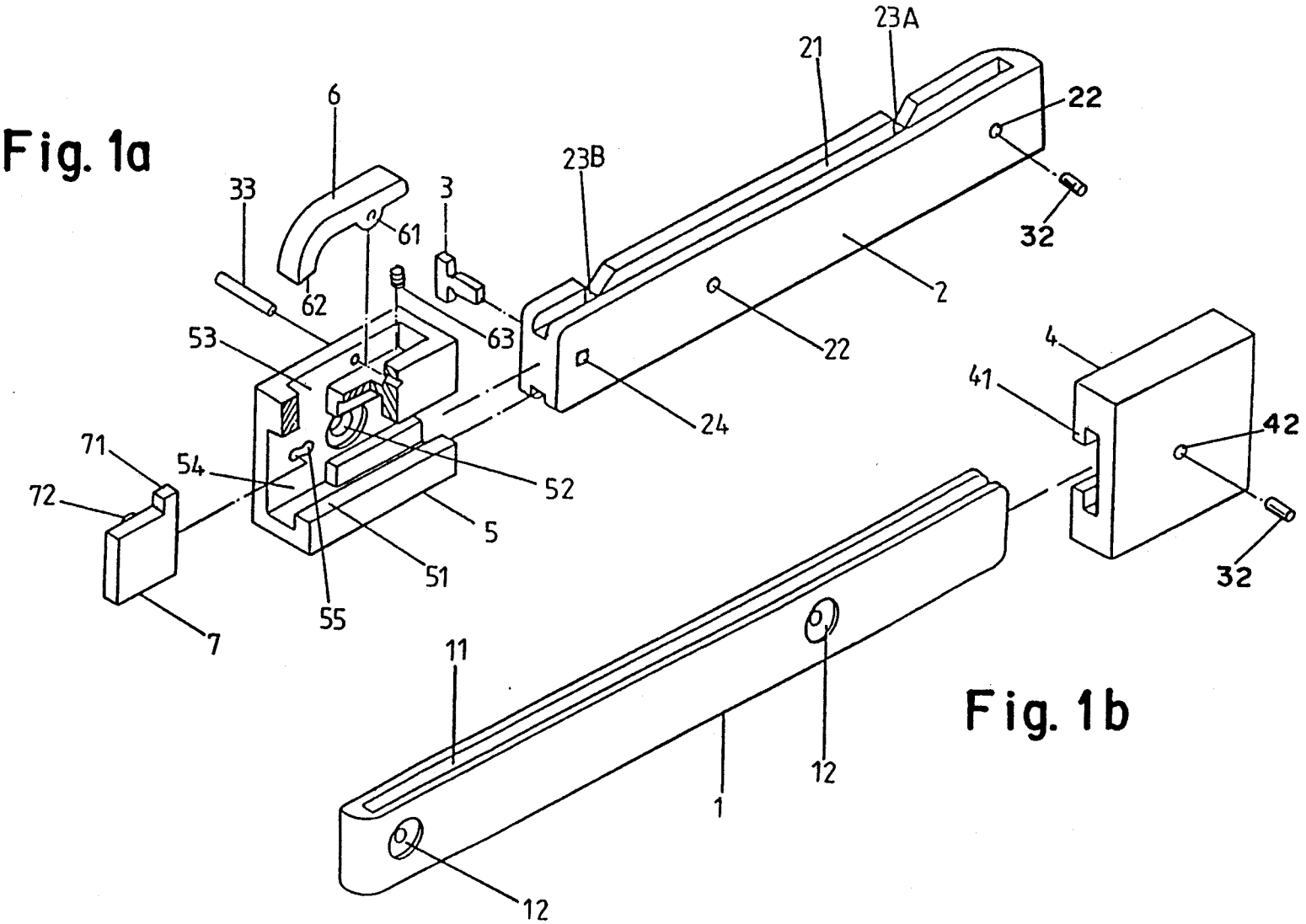
FIG. 1*a* shows an exploded view of the lower sliding rail and lower moving member of the present invention.
FIG. 1*b* shows an exploded view of the upper sliding rail and the upper moving member of the present invention.
Figure 2:
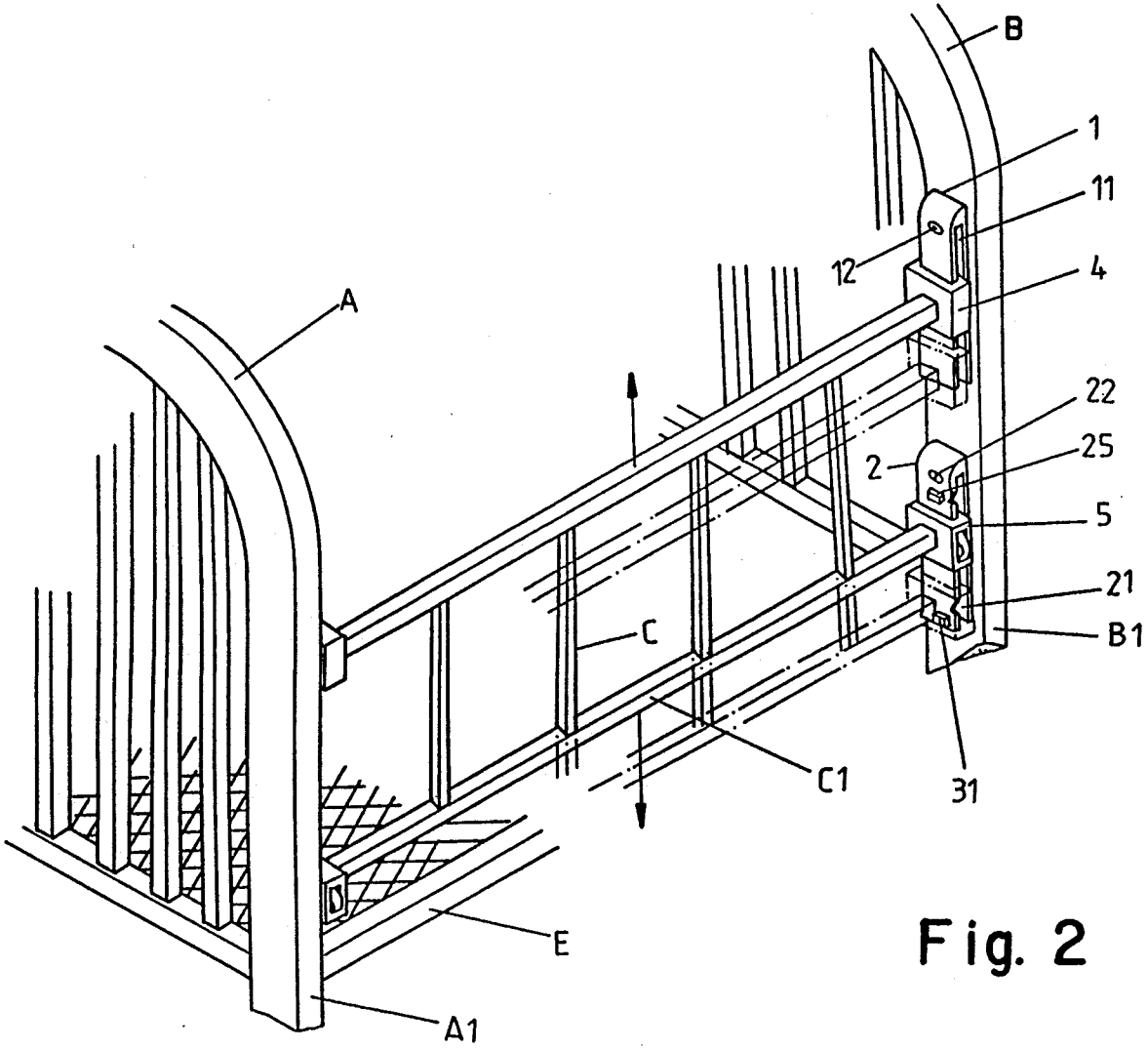
FIG. 2 shows a perspective view of the present invention in combination.

As shown in FIG. 2, two side boards, A and B, are provided respectively with a foot post A1 and a foot post B1. The foot post A1 and B1 are provided respectively with an inner sliding rail 2. The upper and the lower sliding rails 1 and 2 are provided respectively with an upper sliding slot 11 and a lower sliding slot 21. As shown in FIG. 1*a*, the lower sliding rail 2 is provided at the bottom thereof with an insertion hole 24 dimensioned to receive therein an arresting piece 3. The lower sliding rail 2 is further provided at the upper portion thereof with a protruded arresting block 25. The lower sliding rail also has an upper and a lower locating holes, 23A and 23B, respectively, each having a slanted upper edge. The upper and the lower sliding rails 1 and 2 are fastened respectively to the inner side of the foot posts A and B by means of fixing holes 12 and 22 which are engageable with screws.

The upper and lower sliding rails 1 and 2 are provided respectively with an upper moving member 4 and a lower moving member 5, which are in turn provided respectively with an upper sliding block 41 and a lower sliding block 51. As shown in FIGS. 1*a* and 1*b*, the upper and the lower moving members 4 and 5 are further provided respectively with an upper fixing hole 42 and a lower fixing hole 52. The upper and the lower moving members 4 and 5 are fastened respectively to cross rails C1 by means of respective fixing holes 42 and 52 which are engageable with fastening screws 32. The lower moving member 5 is provided with a control frame slot 53 in which a control frame 6 is disposed securely by means of the pin hole 61 and the fastening pin 33. The control frame 6 is provided at the front end thereof with a retaining block 62. The control frame 53 is further provided with a sliding slot 54 in which a movable plate 7 is disposed. The movable plate 7 is provided with a protruded block 71 and a retaining protuberance 72 dimensioned to fit into a FIG. 8 shaped retaining recess 55 of the lower moving member 5. The control frame 6 is further provided with a spring 63 which is located in the control frame slot 53 of the lower moving member 5.

As shown in FIG. 2, a crib is composed of two side boards A and B, a bottom board E, and crib rails C. One rail C (not shown) may be fastened to side boards A and B, while another rail C is movable and adjustable upwards and downwards. The foot posts A1 and B1 of the side boards A and B are provided respectively and correspondingly with the upper sliding rail 1 and the lower sliding rail 2. The upper and lower moving members 4 and 5 are fastened to both ends of the cross rails C1. The rails C and side boards A and B are joined together by means of the upper and the lower sliding slots 11 and 21 of the upper sliding rail 1 and the lower sliding rail 2 in conjunction with the upper and the lower sliding blocks 41 and 51 of the upper and the lower moving members 4 and 5.

As shown in FIG. 1*a*, the lower sliding rail 2 is provided with the slanted locating holes 23A and 23B. The lower moving member 5 slides between these slanted holes. When the lower moving member 5 moves along lower sliding rail 2 to slanted hole 23A, the lower moving member 5 is automatically locks at 23A, since retaining block 62 enters locating hole 23 and is retained there due to the force of the spring 63. Moving member 5 cannot be pushed downwards.

Figure 4:
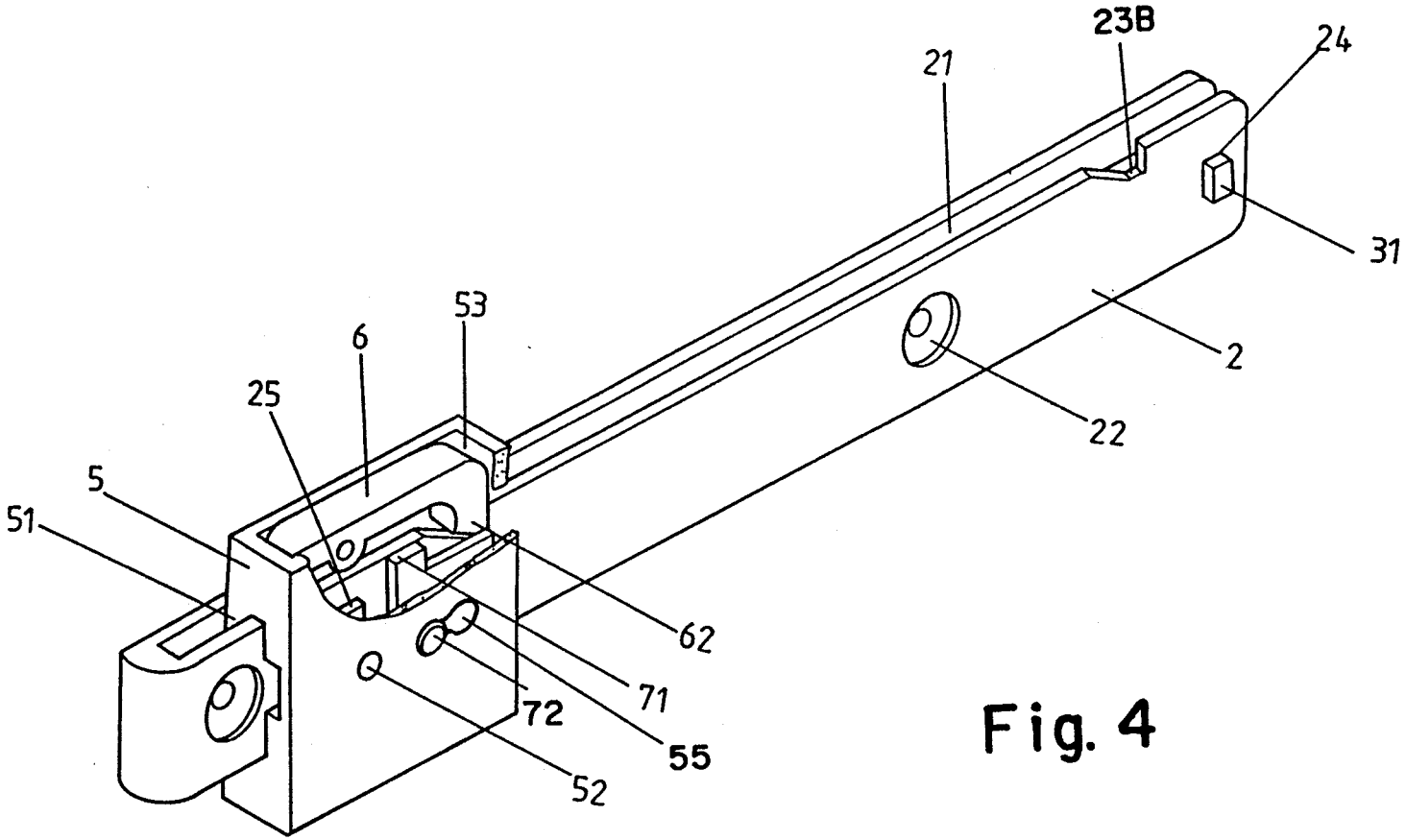
FIG. 4 shows another schematic view of the present invention in a locked position.

As shown in FIG. 4, when the lower moving member 5 is situated at slanted hole 23A, the retaining protuberance 72 of the movable plate 7 is retained in an upper round hole of retaining recess 55 such that the protruding block 71 of the movable plate 7 is not situated under the bottom of the retaining block 62 of the control frame 6 located in the control frame slot 53. As a result, retaining block 62, and thus the crib rail C, is fastened securely in the slanted hole 23A. Downward pressure on the crib rail C will not cause it to move.

Figure 3:
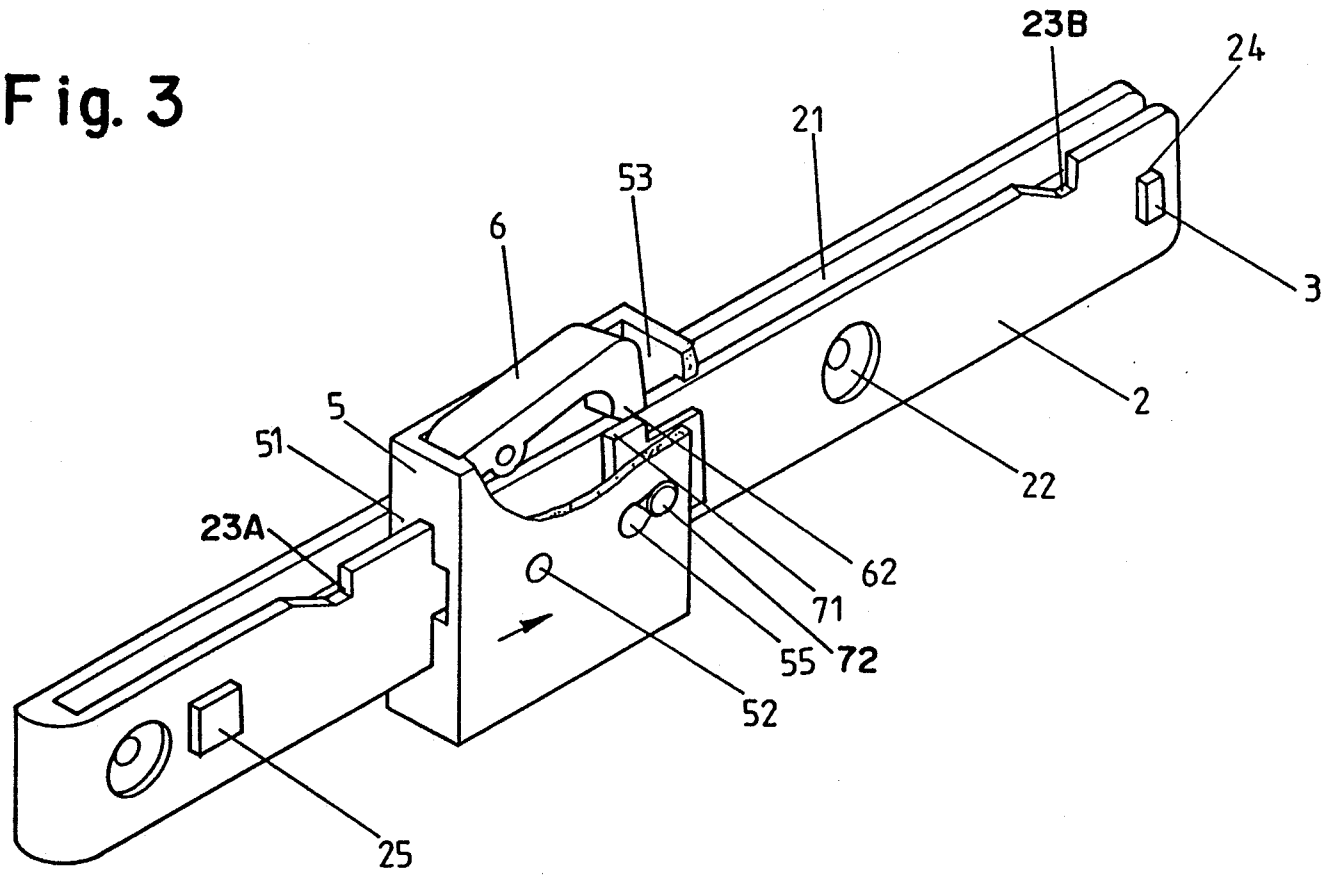
FIG. 3 shows a schematic view of the lower moving member of the present invention moving downward.

The rail C can be lowered by first lifting the rail C causing arresting block 25 to exert pressure on the front end of movable plate 7, causing the retaining protuberance 72 of the moveable plate 7 to move from the upper round hole to the lower round hole in retaining recess 55. In the meantime, the retaining block 62 of the control frame 6 is pushed up by the protruded block 71 of the movable plate 7 (unlocked, moving downward position shown in FIG. 3), and is no longer situated in the slanted hole 23A. As a result, the rail C can be easily moved downwards as shown in FIG. 3.

When the rail C is moved to a bottom position at 23B, additional pressure will cause the protruded portion of the bottom of the movable plate 7 of the lower moving member 5 to be acted on by the arresting piece 3 in the insertion hole 24, moving retaining protuberance 72 from the lower round hole to the upper round hole in retaining recess 55. As a result, the rail C can be easily positioned, since retaining block 62 is no longer held in position by retaining protuberance 72, and may be returned upwards to 23A, where it will again automatically lock.

The embodiment of the present invention described above is to be regarded in all respects as merely illustrative and not restrictive. Accordingly, the present invention may be embodied in other specific forms without deviating from the spirits thereof. Therefore, the present invention is to be limited only by the scope of the following appended claim.

What is claimed is:

1. A crib comprising:

side boards (A,B);

a crib rail (C) to be positioned relative to said side boards;

an upper sliding rail (1) and a lower sliding rail (2) attached to each side board;

an upper moving member (4) and a lower moving member (5) for moving said crib rail along said upper sliding rail and said lower sliding rail respectively;

one of said sliding rails comprising:

an upper (23A) and a lower (23B) locating hole, and an upper (25) and a lower (3) arresting block located closer to an end of said sliding rail than said upper and said lower locating hole respectively; and said moving member moving along said one of said sliding rails comprising:

a control member (6) comprising means for retaining (62) said moving member in said locating holes;

a movable plate (7) having a first position for biasing said retaining means (62) in a position (FIG. 3) in which said retaining means cannot retain said moving member in said locating holes (23A, 23B) and a second position (FIG. 4) which does not influence said retaining means, said upper arresting block being situated for moving said movable plate from said second position to said first position and said lower arresting block being situated for moving said movable plate from said first position to said second position.

2. The crib as recited in claim 1 wherein said upper sliding rail and said lower sliding rail are disposed respectively in an inner side of an upper portion and an inner side of a lower portion of said foot post of said side boards, said upper sliding rail and said lower sliding rail being provided respectively with an elongate sliding slot on both sides.

3. The crib as recited in claim 1, wherein said locating holes include a slanted upper edge.

4. The crib as recited in claim 1 further comprising a control frame slot (53) containing said control member (6) and including a sliding slot in which said movable member moves.

5. The crib as recited in claim 4, wherein said movable plate further comprises a retaining protuberance (72) and said control frame slot further comprises a figure eight shaped hole (55) receiving said retaining protuberance.

6. The crib as recited in claim 5, further comprising means for fastening (61, 33) said control member (6) to said control frame slot (53), said fastening means allowing said control member (6) to rotate.

7. The crib as recited in claim 2, further comprising a spring (63) located under said control member (6) at an end of said control member opposite said retaining means (62).

8. The crib as recited in claim 2, said one of said sliding rails being said lower sliding rail.

9. An apparatus for positioning a crib rail comprising:

a sliding rail (2) comprising:

an upper (23A) and a lower (23B) locating hole, and an upper (25) and a lower (3) arresting block located closer to an end of said sliding rail than said upper and said lower locating hole respectively;

means for attaching (22) said sliding rail to a crib; and a moving member (5) for positioning said crib rail along said sliding rail, said moving member comprising:

a control member (6) comprising means for retaining (62) said moving member in said locating holes;

a movable plate (7) having a first position for biasing said retaining means (62) in a first position in which said retaining means cannot retain said moving member in said locating holes (23A, 23B) and a second position which does not influence said retaining means, said upper arresting block being situated for moving said movable plate from said second position to said first position and said lower arresting block being situated for moving said movable plate from said first position to said second position.

10. The apparatus as recited in claim 9, wherein said locating holes include a slanted upper edge.

11. The apparatus as recited in claim 9, further comprising a control frame slot (53) containing said control member (6) and including a sliding slot in which said movable member moves.

12. The apparatus as recited in claim 11, wherein said movable plate further comprises a retaining protuberance (72) and said control frame slot further comprises a figure eight shaped hole (55) receiving said retaining protuberance.

13. The apparatus as recited in claim 11, further comprising means for fastening (61, 33) said control member (6) to said control frame slot (53), said fastening means allowing said control member (6) to rotate.

14. The apparatus as recited in claim 9, further comprising a spring (63) located under said control member (6) at an end of said control member opposite said retaining means (62).

* * * * *